US009125252B1

(12) United States Patent
Jacobs et al.

(10) Patent No.: US 9,125,252 B1
(45) Date of Patent: Sep. 1, 2015

(54) POWER LINE COMMUNICATION SYSTEM AND METHOD FOR CONTROL OF LAMP DIMMING

(71) Applicant: Universal Lighting Technologies, Inc., Madison, AL (US)

(72) Inventors: Henry Jacobs, Austin, TX (US); Michael Diaz-Tello, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/196,118

(22) Filed: Mar. 4, 2014

Related U.S. Application Data

(60) Provisional application No. 61/772,377, filed on Mar. 4, 2013.

(51) Int. Cl.
*H05B 37/02* (2006.01)

(52) U.S. Cl.
CPC ..... *H05B 37/02* (2013.01)

(58) Field of Classification Search
USPC ..... 315/291, 307; 340/12.32, 12.35
See application file for complete search history.

(56) References Cited

U.S. PATENT DOCUMENTS

| | | | | |
|---|---|---|---|---|
| 5,471,119 | A * | 11/1995 | Ranganath et al. | 315/307 |
| 7,009,348 | B2 * | 3/2006 | Mogilner et al. | 315/307 |
| 7,042,173 | B2 * | 5/2006 | Huber | 315/318 |
| 7,843,145 | B2 | 11/2010 | McKenzie et al. | |
| 8,405,488 | B1 | 3/2013 | Jacobs et al. | |

* cited by examiner

*Primary Examiner* — Thuy Vinh Tran
(74) *Attorney, Agent, or Firm* — Patterson Intellectual Property Law, P.C.; Mark J. Patterson; Gary L. Montle

(57) ABSTRACT

A power line communication system and signaling protocol is usable for quick dimming of an electronic ballast. An encoding circuit transmits message frames having encoded control signals across a AC power line. Each of a first set of frames includes a bit pattern corresponding to a lighting zone, and a second set of frames includes hamming-encoded bit patterns corresponding to respective hexadecimal digits of a dimming level for the lighting zone. A ballast in a first (quick-dim) configuration detects the second set of frames, decodes the hamming-encoded digits and immediately adjusts the ballast output to the desired power level. The ballast in a second (normal) configuration determines the desired power level based on a pattern density in the first set of frames, and adjusts the output current of the ballast accordingly. If the ballast of the first configuration fails to detect the second set of frames, it defaults to pattern density recognition.

20 Claims, 4 Drawing Sheets

POWER LINE COMMUNICATION SYSTEM AND METHOD FOR CONTROL OF LAMP DIMMING

CROSS-REFERENCES TO RELATED APPLICATIONS

This application claims benefit of the following patent application(s): U.S. Provisional Application No. 61/772,377, filed Mar. 4, 2013, which is herein incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to providing dimming control signals for lighting ballasts. More particularly, this invention pertains to encoding dimming signals for a ballast over a power line to reduce the amount of time in implementing a desired change in lighting power levels.

Referring to FIG. 1, a single-burst signaling system 100 is shown as previously known in the art. This system uses a high frequency burst 102 of approximately 9.8 kHz transmitted coincident with the zero crossings 104 of the AC mains 106. The presence or absence of the burst within a group of eight zero crossings 108 (or one frame 108) represents the logical state of each bit 110. In the example shown, a single burst within a group of zero crossings, or set, decodes as "0". No bursts detected within a set decodes as "1". The bits are organized into repeating bit patterns having a one-to-zero density that is proportional to the desired dimming level. The repetitive bit patterns are encoded such that ones and zeros are proportionally distributed, allowing larger groups of bits 112 (super-frames 112) to be evaluated anywhere within the repeating pattern.

The single-burst signaling system unfortunately does not adequately accommodate more than one control channel. It is desirable in many modern ballasts to provide, in addition to dimming level control signals as above, remote capability for sending commissioning messages, tuning control of the maximum and/or minimum light output for a ballast, and daylight harvesting signals to automatically adjust the light output in response to changes in the ambient light level in a particular area. While multiplexing of signals from more than one source along a common communications line is known to those of skill in the art, a single-burst signaling system cannot distinguish between various sources along the line.

Various systems are further known to those of skill in the art for generating and detecting pulses carrying ballast control information over a power line. However, in some of these systems detection of the transmitted pulses is difficult where the pulse width changes in response to changes in the input voltage. Other systems have the disadvantage of causing unintentional lamp dimming in the presence of high levels of power line noise about the control signals transmitted to the ballast.

It is desirable to provide a system for generating and transmitting control signals from multiple control sources over a common power line to a ballast configured to detect the signals.

Further, various conventional methods of controlling lighting levels over the power line have a substantial delay (e.g., of about 26.7 seconds in one example) to slew from minimum to maximum brightness. It would be desirable to reduce the response time for a level change from, e.g., 26 seconds to only 2 seconds.

It would further be desirable to provide this feature while maintaining compatibility with existing systems already installed in the field.

BRIEF SUMMARY OF THE INVENTION

A system and method are provided for encoding dimming signals for fluorescent ballasts over a power line. An exemplary system implementing a "Quick Dim" method as disclosed herein is compatible with systems implementing previously known methods and reduces the time to change levels to 1.8 second. Quicker response time improves the user experience when using dimmers or sensors and also allows for more application to use the system and thus increase commercial opportunities.

In various embodiments as disclosed herein, Hamming codes are used in a novel way in conjunction with parity to allow backwards compatibility with the existing dimming systems, such as for example Demand Control Lighting® systems from Universal Lighting Technologies. If noise corrupts the dimming level message, then the usual pattern-density algorithm will still be used and the system will dim to the correct level at the usual rate of 26.7 seconds.

DETAILED DESCRIPTION OF THE INVENTION

Figure 1:
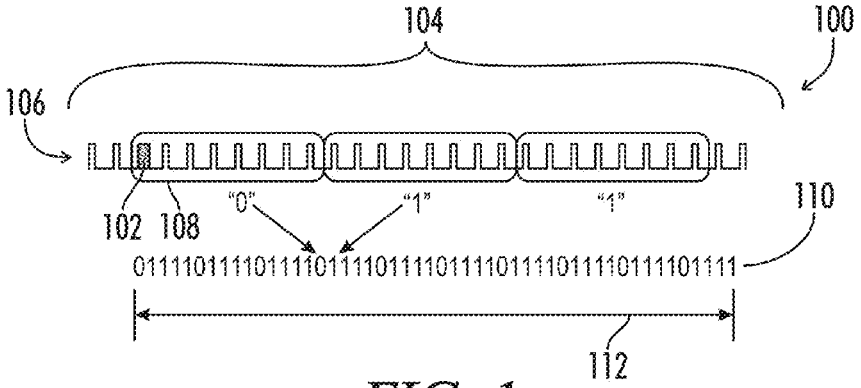
FIG. 1 (PRIOR ART)
FIG. 1 is a diagram representing a single burst signaling protocol for a power line communication system as previously known in the art.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Referring generally to FIGS. 2-6, various embodiments of a system and method for encoding, transmitting and decoding dimming control signals across an AC power line will be herein described. In the embodiments detailed below, the system and method are applied to an electronic ballast for powering and dimming at least one gas discharge lamp, but it may be anticipated that the concepts herein are applicable in various alternative systems as well.

Figure 2:
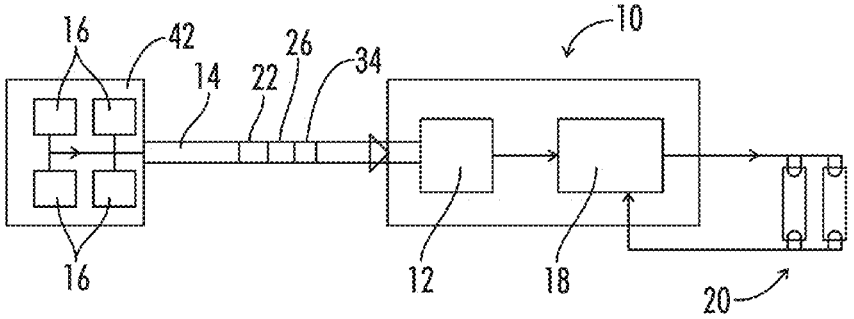
FIG. 2 is a block diagram representing an embodiment of an encoding system according to the present invention.

Referring now to FIG. 2, an exemplary fluorescent ballast 10 for powering a load 20 is provided with a power line communications signal receiving circuit 12 coupled to an AC mains power line 14. The receiving circuit 12 may be a microprocessor 12 or equivalent controller configured as described below to receive AC signals and decode control signals transmitted within the AC signals. The receiving circuit 12 is further coupled to ballast control circuitry 18 within the ballast 10 for transmitting decoded control signals as further described below. The ballast control circuitry 18 is configured to power the load 20 such as a fluorescent lamp 20 and may generally include an inverter, an inverter driver, and a power factor correction controller. The ballast control circuitry 18 is effective thereby to act in response to control signals and to dim one or more lamps 20. The receiving circuit 12 and the ballast circuitry 18 may be in separate sections on a common printed circuit board, or may be integrally composed with the ballast circuitry 18 in a common integrated circuit (not shown) or may be local but separate from the ballast 10 itself and electronically coupled to the circuitry 18 in question (also not shown).

One or more encoding circuits 16 or control sources 16 are coupled along the AC power line 14. Each of the control sources 16 is configured to provide a control signal to the ballast 10 associated with one or more particular functions. The control sources 16 may generally be incorporated within a common computer system 42 in, for example, a control tower. The control sources 16 may alternatively be located in various positions along the AC power line 14, as long as the capability remains to combine signals from the various control sources 16 on the power line 14 in a manner readable by the receiving circuit 12.

Figure 3:
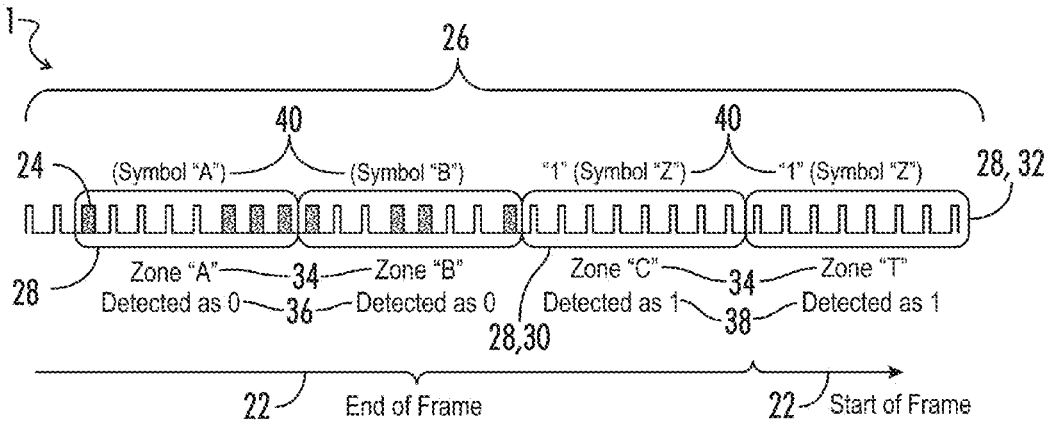
FIG. 3 is a diagram representing an exemplary signaling protocol in accordance with various embodiments of the present invention.

Referring now to FIGS. 2 and 3, various embodiments of a system as disclosed herein substitute the single burst frame of power line communications as previously known in the art with a multiple burst encoding system 1. This system includes a plurality of distinct frames 22 each represented by a series of high frequency energy bursts 24 or pulses 24 provided at zero crossings 26 of the AC mains power signal 28 which is received by the receiving circuit 12. The energy bursts 24 in an embodiment may be 9.6 kHz tone-bursts 24 having a pulse width selected to further facilitate detection of the bursts 24, but may be provided in a number of different configurations as known in the art. Further, detection of bursts 24 provided at zero crossings of the AC mains signal by a signal receiving circuit 12 may be performed in a variety of ways as known in the art and within the scope of the present invention. Each of the one or more control sources 16 provide a series of bursts 24 along a plurality of zero crossings 26 defining a set 28, or data block 28 as commonly known in the art. The individual zero crossings 26 may also be referred to as bits 26, as further commonly known in the art. Each series of bursts 24 is provided in a particular and predetermined pattern defining a symbol 40.

In an embodiment as shown, various sets 28 include an 8-bit pattern of bursts beginning with a single burst 24, followed by a no-burst and then a 6-bit sequence to represent the remainder of the pattern and define a particular symbol 40. A plurality of different symbols 40 (herein four symbols denoted A, B, C and T) may be used to represent a data block 28 with value or logic condition "0" and will have the general format "bNxxxxxx". The letter "b" represents a 9.6 kHz energy burst 24 and each "N" represents the absence of such an energy burst in a bit 26 or zero crossing 26. There is a unique 6-bit pattern "xxxxxx" for each symbol 40 (A, B, C or T).

The symbol 40 for a received data block 28 having logic condition of "1" may be represented in an embodiment as shown by a lack of bursts "NNNNNNNN", and may further be denoted as symbol "Z". The use of the term "pattern" or "arrangement" of bursts 24 within a set 28 may be intended therefore to encompass a set 28 having no bursts 24 at all.

Time division multiplexing may be used to incorporate sets 28 from each of the one or more control sources 16 that are transmitting encoded control signals into a sequential transmission along the AC power line 14. The transmission is divided into recurring frames 22 of a predetermined length, each frame 22 including one set 28 from each control source 16. After a frame 22 has concluded with the last set 28, 30 in a sequence, the transmission picks up with a first set 28, 32 from a first control source 16 and begins transmitting another frame 22 in the same sequence.

In an embodiment as shown in FIG. 3, time division multiplexing may be used to create a 32-bit frame of four channels 34 having eight bits 26 or zero crossings 26 apiece. Each channel 34 represents an individual control source 16 and is further associated with a particular symbol 40 which will indicate the desired control signals for that particular control source 16. Stated differently, a particular symbol 40 for each control channel 34 may be provided to represent a first logic condition 36 associated with instructions to carry out a specified control function. A different symbol may be provided to represent a second logic condition 38 associated with instructions to ignore the specified control function for that control channel 34.

As multiple frames 22 are received and decoded, the arrangement of sequential logic conditions 36, 38 associated with a particular control channel 34 may be analyzed to detect a control signal with greater precision. For example, a particular arrangement of "0" and "1" logic conditions 36, 38 provided over a predetermined number of frames 22 decoded with respect to a first control channel 34 may be programmed to indicate a particular control response. In alternative control channels 34, each received logic condition 36, 38 may individually indicate a control adjustment for a particular parameter. Various systems and methods may be anticipated for encoding and decoding control signals of varying complexity.

In the embodiment shown, the first symbol 40 is used to transmit commissioning messages and for ballast tuning. The second symbol 40 is used for the primary dimming channel. The third and fourth symbols 40 are used for daylight harvesting dimming channels. Each dimming channel 34 may be controlled independently. In this manner the use of multiple independent channels A, B, C, T transmitted to a ballast 10 along a common power line 14 allows the ballast 10 to be placed into particular zones without the need to change existing building wiring. It may be understood that various alternative uses, control channels and associated symbols are within the scope of the present invention.

Symbols 40 used for each control channel 34 are unique and in various embodiments are preferably chosen such that a Hamming distance between any two symbols 40 is greater than or equal to three. This allows single bit errors to be well tolerated.

Referring now to the Tables A and B below, single-bit error correction with Hamming distances greater than or equal to three requires six data bits 26 for the signal pattern and two data bits 26 for the starting sequence, for a total of eight bits 26 to be transmitted. 32:1 multiplexing as known in the art is used, which allows for four separate zones 34 or control channels 34, including three dimming channels and a commissioning or tuning channel. Table A represents codes associated with various symbols 40 in an embodiment as shown in FIG. 3:

TABLE A

| Symbol | Decimal (hex) | Binary | Hex Code | Decimal |
|---|---|---|---|---|
| A | 14 (0x0E) | 10001110 | 0x8E | 142 |
| B | 19 (0x13) | 10010011 | 0x93 | 147 |
| C | 52 (0x34) | 10110100 | 0xB4 | 180 |
| T | 41 (0x29) | 10101001 | 0xA9 | 169 |

Table B represents Hamming distances between the various symbols in an embodiment as shown in FIG. 3:

TABLE B

| Symbol | A | B | C | T | Z |
|---|---|---|---|---|---|
| A | 0 | 4 | 4 | 4 | 4 |
| B | 4 | 0 | 4 | 4 | 4 |

TABLE B-continued

| Symbol | A | B | C | T | Z |
|---|---|---|---|---|---|
| C | 4 | 4 | 0 | 4 | 4 |
| T | 4 | 4 | 4 | 0 | 4 |
| Z | 4 | 4 | 4 | 4 | 0 |

Receiving circuit 12 is arranged to receive the AC signal across the AC power line 12 and to decode the provided control signals. In various embodiments, decoding the control signals includes determining which of the plurality of defined symbols (for example: A, B, C, T or Z) is most likely to have been indicated by a received symbol transmitted across the AC power line. Noise on the line can corrupt the transmitted signal, so the received symbol may not be identical to any of the defined symbols.

The Hamming distance between the received symbol "x" and each of the defined symbols may be used to determine the symbol that was most likely to have been encoded and transmitted. The Hamming distance between two symbols of equal length is defined as the number of positions for which the corresponding symbols are different, as is generally known in the art. The notation d(x, A) may be used to denote the Hamming distance between received symbol "x" and defined symbol "A". In certain embodiments, decoding control signals from the transmitted symbol therefore include computing metrics for each of the defined symbols with respect to the received symbol and choosing the smallest Hamming distance, corresponding to the most likely symbol that was sent. With regards to the embodiment as shown in FIG. 3, the applicable metrics for computation would be: d(x, Z); d(x, A); d(x, B); d(x, C); d(x, T).

The receiving circuit 12 may buffer a fixed number of symbols to decode the control signals. The receiving circuit 12 may, for example, be arranged to buffer one hundred symbols, in which case the control signals are decoded to a resolution of one percent. As each new control signal is received, the oldest symbol is accordingly discarded. For a typical line frequency of 60 Hz, the receiving circuit buffer requires 26.7 seconds to completely clear a symbol from the buffer. The relatively slow transition creates an inherent low pass filter, and accordingly single symbol errors cannot have an instant and substantial effect on light dimming levels.

The receiving circuit 12 may further be programmed to respond to one or more of the dimming symbols and the commissioning/tuning symbol. In various embodiments such as shown in FIG. 2 where the system includes an electronic ballast, the receiving circuit 12 may be a microprocessor 12 that, for example, applies control signals directly to an inverter driver and dims a fluorescent lamp in accordance with the received control signals.

The potential improvements due to using an 8-bit Hamming symbol rather than a single-bit symbol can be quantified, as shown by referring to the following Table C illustrating a probability of single-bit error (q), and probability of single-bit error after Hamming corrections (Qh) when using 8-bit symbols, and the Improvement Ratio (q/Qh):

TABLE C

| q | p = (1 − q) | P0 | P1 | Qh | q/Qh |
|---|---|---|---|---|---|
| 0.1 | 0.9 | 0.4305 | 0.38624 | 0.186895270 | 0.54 |
| 0.01 | 0.99 | 0.9227 | 0.07457 | 0.002690078 | 3.72 |
| 0.001 | 0.999 | 0.9920 | 0.00794 | 0.000027888 | 35.86 |
| 0.0001 | 0.9999 | 0.9992 | 0.00080 | 0.000000280 | 357.29 |
| 0.00001 | 0.99999 | 0.9999 | 0.00008 | 0.000000003 | 3571.57 |

where:

q=the probability of single-bit error;

p=1−q=the probability of correct symbol being received;

P0=the probability of receiving an 8-bit symbol with no (0) errors, computed using binomial distribution;

P1=the probability of receiving an 8-bit symbol with single-bit (1) error, computed using binomial distribution (this error can be corrected using Hamming distance);

P0+P1=the probability of receiving a correctable symbol;

Qh=the probability of receiving an incorrect symbol with Hamming corrections used, or stated otherwise the probability of uncorrectable error;

q/Qh=the improvement ratio using Hamming corrections over receiving a single-bit symbol.

As may be seen, single-bit error correction is quite effective and becomes even more effective as the bit rate error decreases. This can be explained because the probability of double-bit errors varies as (q)*(q) which decreases exponentially. Correction of more than single-bit errors is generally not required.

Figure 4:
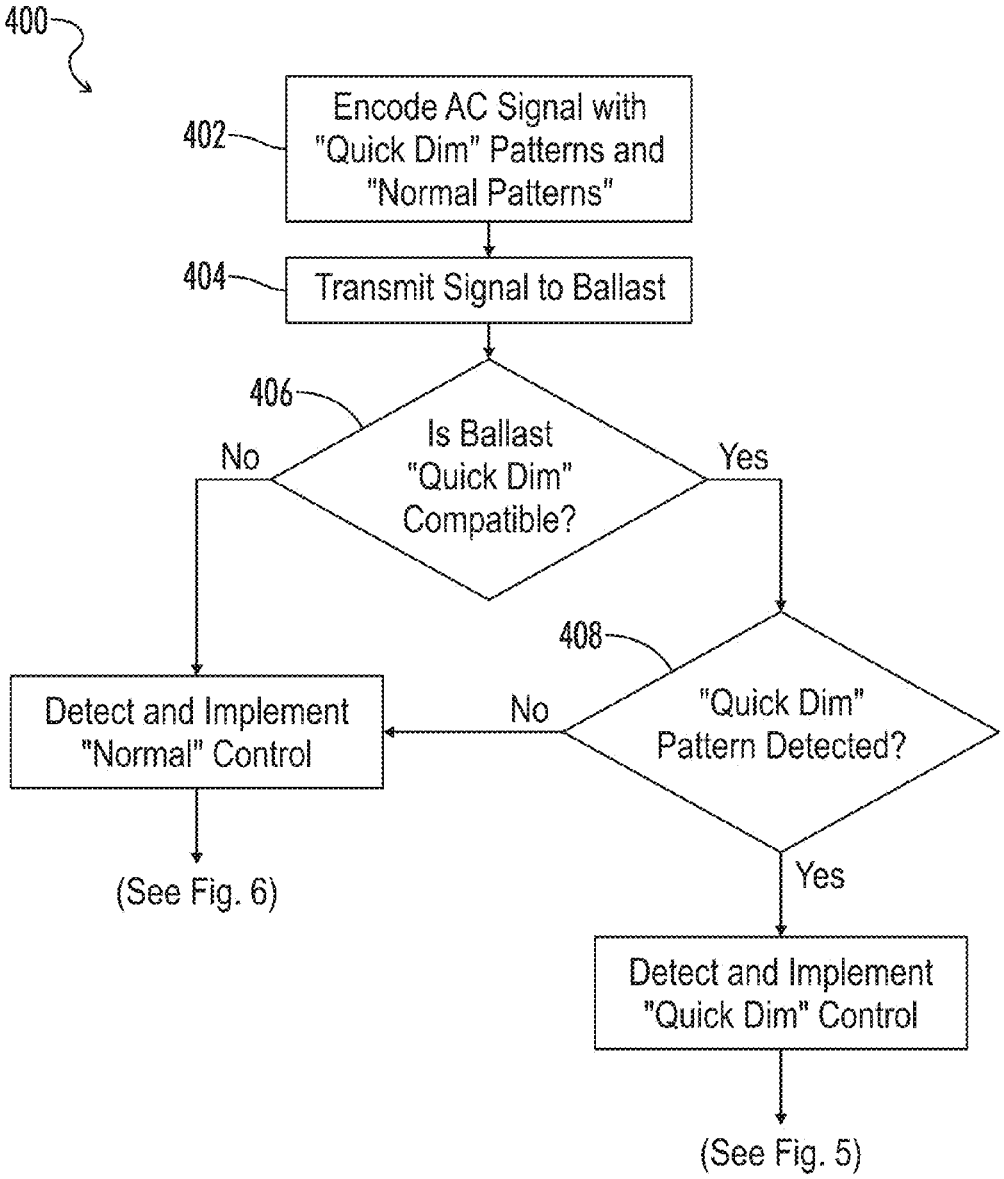
FIG. 4 is a flowchart representing an exemplary dimming control method according to an embodiment of the present invention.

Referring now to FIG. 4, a method 400 and rationale may now be described for a signaling protocol on the power line for quick dimming in accordance with systems of the present invention. The method 400 may allow for a level change in less than two seconds as opposed to the twenty-eight seconds via "normal" control sequences required by previous designs. The "quick dimming" design as disclosed herein is backwards compatible with previous systems but in various embodiments requires changes to controller firmware, for example in one or more of the ballast and a circuit control module.

The method 400 begins in step 402 where a power line signal is encoded with a combination of a first set of patterns and a second set of patterns. The first set of patterns may in an embodiment generally correspond to a "Quick Dim" protocol as disclosed herein, while the second set of patterns may generally correspond to a "normal" protocol as would be implemented by previously known ballast controllers. The power line signal is then transmitted to one or more ballasts in the desired lighting area (step 404).

One embodiment of the "Quick Dim" pattern as disclosed herein may be referred to as "message based" instead of "signal density" based as with the "normal" pattern. A special message is sent to each channel (zone) to command the new output power level. This message has two parts, each of which is one byte. Each byte is a Hamming-encoded symbol. The desired power level is a 7-bit value to which even parity is added as the most significant bit (msb) to produce an 8-bit value. The resulting byte is broken into two nibbles (4-bits), each of which is encoded into 7-bits using a Hamming coding. The values of each nibble are the (7-bit) complement of the standard Hamming (4, 7) encoding. Taking the complement is required to prevent collisions with existing zone symbol values, or shifted versions of existing zone symbols. Even parity for each byte is then added to the most significant bit for each byte so that each byte has an odd number of 1's, or odd parity. This is done to distinguish the level from a zone symbol, since all zone symbols have even parity, or an even number of ones (exemplary zone symbols may be 0xA9, 0x8E, 0x93, and 0xB4). The byte corresponding to the most significant nibble is sent first and the byte corresponding to the least significant nibble is sent second.

One example may be as follows:

10%=0x0A (odd parity)→Add 0x80 for even parity to give 0x8A

First nibble=0x8 and Second nibble=A

Hamming (4, 7) [0x8]=0x38; 7-bit complement is 0x47;

Then add parity bit to give 0xC7 as "First Hamming Symbol"

Hamming (4, 7) [0xA]=0x5A; 7-bit complement is 0x25;

Then add parity bit to give 0x25 as "Second Hamming Symbol"

The use of Hamming encoding in accordance with methods of the present invention provides forward error correction that allows the receiver to correct for errors occurring on the power line. Odd parity provides additional error detection. Odd parity is used rather than even parity because the existing zone symbols all have even parity, and this allows the receiver to distinguish Quick Dim messages from the Zone Symbols, which is important for resynchronization of message frames by the receiver. Repeating the message also improves error correction and improves the probability of receiving the message.

The bytes are sent during consecutive time-slots for the zone being controlled (step 404). Each message is preceded by the zone-symbol for the zone being controlled. An example for sending 55% to Zone A is shown below:

"A-symbol" . . .
"First Hamming Symbol" . . .
"Second Hamming Symbol" . . .
"A-symbol" . . .
"First Hamming Symbol" . . .
"Second Hamming Symbol" . . .
"A-symbol" . . .
(Resume symbol density scheme by sending A-symbol at a rate proportional to dim level.)

A standard method for sending the power level using the density of zone symbols is then sent. This makes the method backwards-compatible with previous ballasts that do not recognize a "Quick-Dim" message protocol as disclosed herein.

If a given ballast is not programmed to accept and decode the first set of patterns, or otherwise for example is not "Quick Dim" compatible (i.e., "no" in response to the query in step 406), the controller may detect and implement lighting control based on the second set of patterns, as described below with reference to FIG. 6.

Alternatively, if a given ballast is programmed to accept and decode the first set of patterns, or otherwise for example is "Quick Dim" compatible (i.e., "yes" in response to the query in step 406), the controller may seek to detect the first set of patterns (step 408). For various reasons, such as for example the presence of noise, the controller may be unable to detect the first set of patterns, wherein the ballast defaults to normal lighting control based on the second set of patterns.

Figure 5:
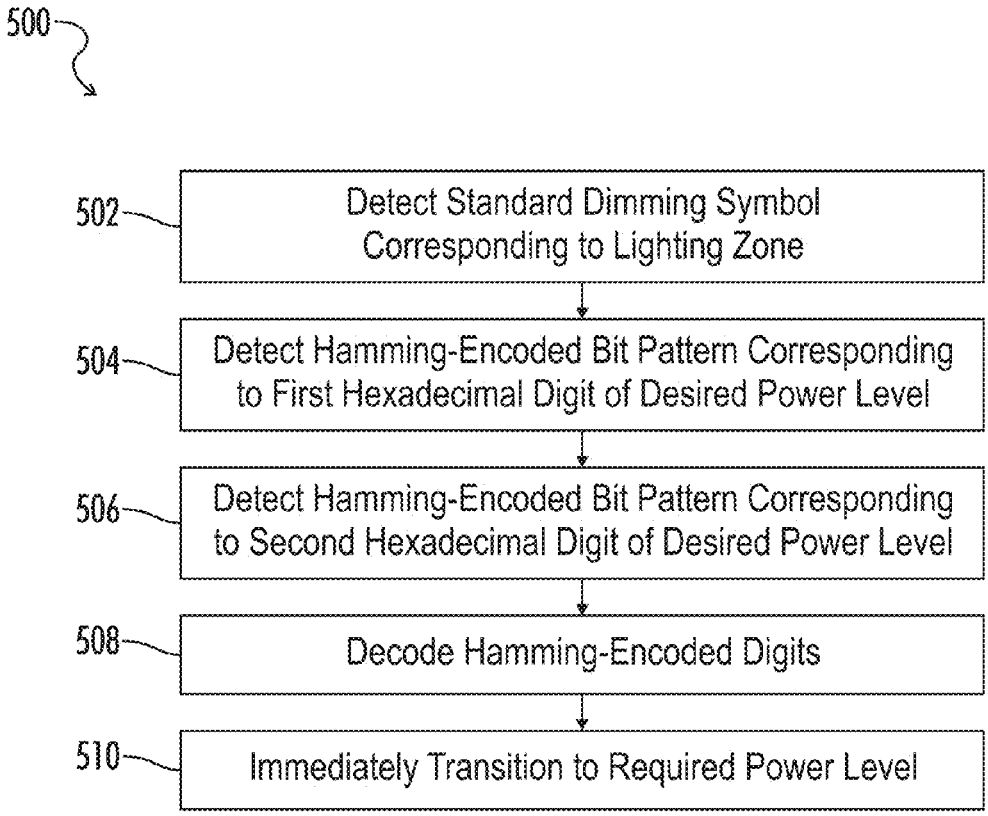
FIG. 5 is a flowchart representing an exemplary "quick dim" scheme according to an embodiment of the present invention.

Otherwise, the controller may preferably detect and implement "Quick Dim" lighting control based on the first set of patterns, as described next with reference to FIG. 5.

The quick-dimming receiver code may work in a manner similar to the previous (e.g., demand response) receiver code. First, the receiver determines whether the power-line signal is in a zero crossing interval. Then, it determines whether a 9.6 kHz burst is present and updates a shift register accordingly. After every 32nd zero crossing (i.e., the time for one message frame), the receiver checks the contents of this shift register to determine whether the burst pattern corresponds to a dimming symbol. The receiver then shifts a 1 or a 0 into another register (depending on the absence or presence of a dimming symbol) which controls the output current of the ballast (the density of 1's corresponds to the % of output current).

In contrast with the old dimming scheme, the quick-dimming receiver code also checks for a sequence of quick-dimming symbols among the regular dimming symbols. In step 502 (FIG. 5), the receiver first checks for a standard dimming symbol corresponding to the zone the ballast is in (e.g. zone A is 0x8E). In the next (second) message frame (step 504), it will look for a hamming-encoded bit pattern corresponding to the first hexadecimal digit of the desired power level. In the third message frame (step 506), it will look for another hamming-encoded bit pattern for the second hexadecimal digit of the desired power level.

If at any time this sequence is disrupted by an incorrect symbol (i.e., noise), the receiver may simply reset the sequence that it is looking for. The transmitting unit will typically broadcast a quick-dimming message twice in a row and then resume its normal dimming scheme, so if the receiver is unable to detect a quick-dimming message for any reason, the receiver can use the old scheme to dim to the requested level with the old delay time of 28 seconds.

If the receiver successfully detects these symbols over three consecutive message frames, in step 508 it decodes the desired power level by first checking the parity bits in each digit to determine the validity of the message. After validating each byte of the power level, the receiver complements the bytes and strips them of their respective parity bits. It then performs a reverse Hamming-table lookup on the new byte-patterns to determine the value of each hex digit. The receiver then recombines the two digits which results in the desired power level and immediately sets the output current to this newly-decoded level (step 510).

This new scheme uses hamming-encoded symbols and parity bits to ensure the integrity of the transmitted message. The bit patterns are complemented to minimize the possibility of hamming symbol collisions with the old set of dimming symbols. Also, the parity scheme used for the encoded message is the opposite of that used for the old dimming symbols. This helps to eliminate the possibility of symbol collisions. These adjustments ensure the new and old systems will not interfere with one another.

Figure 6:
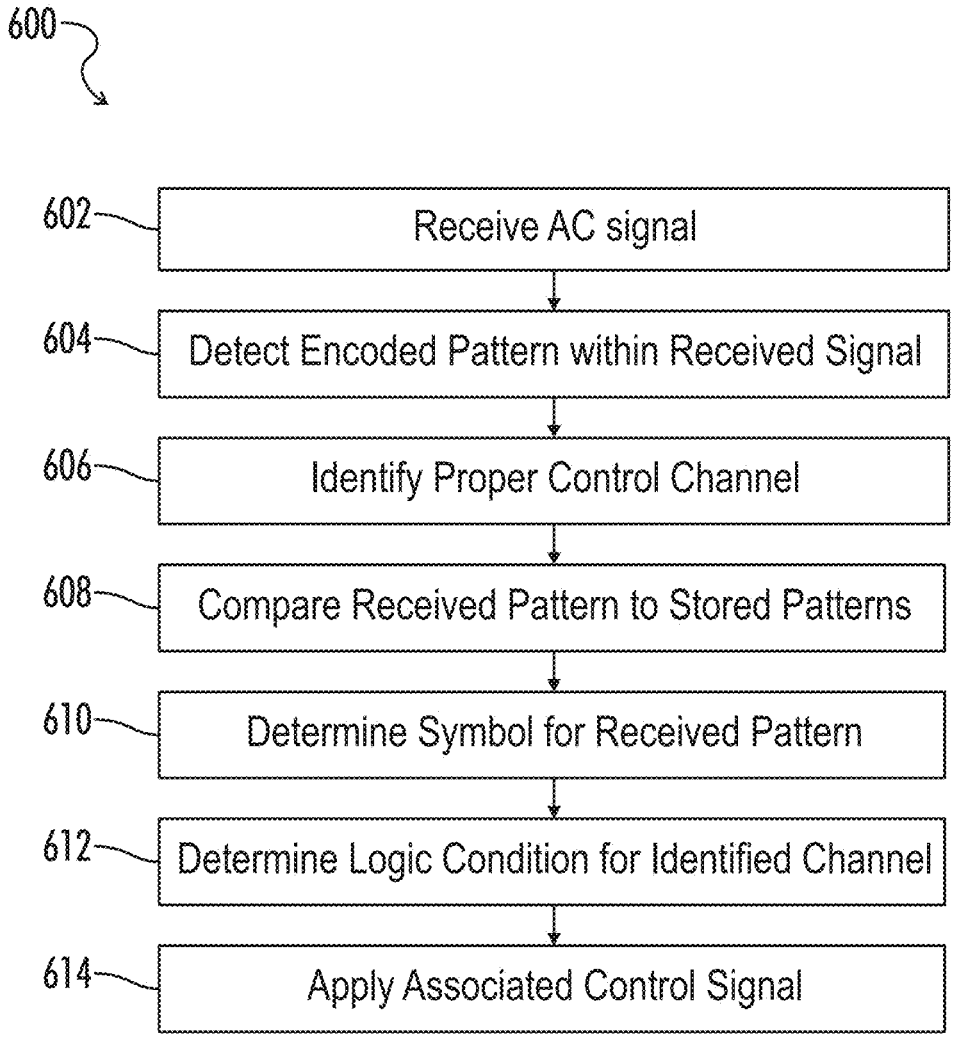
FIG. 6 is a flowchart representing an exemplary "normal" dimming scheme according to an embodiment of the present invention.

Referring now to FIG. 6, one example of a "normal" method 600 of decoding ballast control signals may now be described, wherein for example the ballast firmware is not compatible with the "quick dim" protocol, or such signals have been interfered with by noise. The normal protocol is not limited to the example provided below, but rather one of skill in the art may understand that such a protocol may merely comprise for example a signal density based protocol for dimming control without reference to bit correction, alternative control functions or the like.

The method begins in block 602 by receiving an AC signal transmitted across an AC power line. The controller detects in block 604 each burst and determines the encoded pattern provided in a manner known to those of skill in the art.

In block 606 the method continues by identifying a control channel associated with the set. The sets are provided in a given sequence across the AC power line in various embodiments by Time Division Multiplexing of signals provided from various control sources. The controller identifies the channel associated with the set from among the given sequence such that the encoded signal can be related to the appropriate control function.

In block 608 the method continues by comparing the received pattern with a plurality of stored patterns defining unique symbols. Each symbol has been selected and programmed in accordance with a minimum Hamming distance between the symbol and each other symbol. The controller may then in block 610 detect the unique symbol having a defined pattern with the lowest Hamming distance from the received pattern, thereby determining the symbol associated with the received pattern using single bit correction and substantially avoiding issues that typically accompany high power line noise.

In block 612 the method includes determining a logic condition for the identified channel based on the determined symbol. Each symbol is associated with either of a first logic condition or a second logic condition, also stated as a "0" or a "1" logic condition. In certain embodiments each channel has a unique symbol associated with a first logic condition for that channel, and each channel has a common symbol associated with a second logic condition. Each channel also has an associated control function, with the first and second logic conditions further associated with a control signal to be applied in association with the control function.

In block 614 the method concludes by applying the control signals to the ballast in a predetermined manner associated with the channel and in accordance with the determined logic condition. In one example, the control signals may include a daylight harvesting dimming signal to be applied to the ballast in a manner known to those of skill in the art. The control signals in various embodiments may be applied incrementally over a series of logic conditions provided for the identified channel. The step of applying control signals in such an embodiment may include buffering a predetermined number of sets to incorporate a wider range of input signals into analysis of an encoded control function, and without requiring an inordinate amount of memory space.

Thus, although there have been described particular embodiments of an invention herein, it is not intended that such references be construed as limitations upon the scope of this invention except as set forth in the following claims.

What is claimed is:

1. A lighting control method comprising:

receiving at an electronic ballast an AC signal transmitted across an AC power line, the AC signal comprising a first set of message frames and a second set of message frames, each message frame comprising a pattern of energy bursts provided at respective zero crossings, the first set of message frames comprising a bit pattern corresponding to a lighting zone associated with the ballast, the second set of message frames comprising one or more hamming-encoded bit patterns corresponding to respective hexadecimal digits of a desired power level;

upon detecting the second set of message frames, decoding the hamming-encoded digits and immediately adjusting an output current of the ballast to a value proportional to the desired power level; and upon failing to detect the second set of message frames, determining the desired power level over time based on a pattern density corresponding to the lighting zone, and adjusting the output current of the ballast accordingly.

2. The method of claim 1, wherein the second set of message frames comprises a first frame having a hamming-encoded bit pattern corresponding to a first digit of the desired power level, and a second frame having a hamming-encoded bit pattern corresponding to a second digit of the desired power level.

3. The method of claim 2, wherein the first and second frames being transmitted consecutively across the AC power line, and wherein detecting the second set of message frames comprises consecutively detecting each of the first and second message frames.

4. The method of claim 3, wherein a plurality of second sets of message frames being transmitted consecutively across the AC power line, and wherein detecting the second set of message frames comprises consecutively detecting each of the first and second message frames in any one or more of the second sets of message frames.

5. The method of claim 1, wherein each frame in the first set of message frames comprises an even number of bits, and each frame in the second set of message frames comprises an odd number of bits, and wherein the method further comprises detecting the second set of message frames based on the respective number of bits.

6. The method of claim 1, wherein the step of determining the desired power level based on a density of the bit pattern corresponding to the lighting zone comprises:

comparing the received pattern with a plurality of stored patterns defining unique symbols, each symbol selected in accordance with a minimum Hamming distance between the symbol and each other symbol;

determining the symbol associated with the received pattern;

determining a logic condition for the lighting zone based on the determined symbol; and applying control signals to the ballast in accordance with the determined logic condition.

7. The method of claim 6, wherein a density of the determined logic condition over a predetermined number of message frames corresponds to the desired power level on a percentage scale.

8. The method of claim 7, wherein a minimum Hamming distance of three is defined between each defined symbol.

9. The method of claim 8, wherein the step of determining the symbol associated with the received pattern comprises determining a Hamming distance between the received pattern and each defined symbol and identifying the defined symbol having the smallest Hamming distance with respect to the received pattern.

10. A power line communication system for a lighting dimming control comprising:

at least one encoding circuit which transmits message frames having encoded control signals across a AC power line, the control signals comprising patterns of energy bursts provided by the at least one encoding circuits at zero crossings of an AC mains signal further transmitted across the AC power line, wherein;

a first set of message frames comprising a bit pattern corresponding to a lighting zone, a second set of message frames comprising one or more hamming-encoded bit patterns corresponding to respective hexadecimal digits of a desired power level for the lighting zone;

an electronic dimming ballast coupled to the AC power line and comprising control circuitry, the control circuitry in a first configuration detects the second set of message frames, decoding the hamming-encoded digits and immediately adjusts an output current of the ballast to a value proportional to the desired power level, and the control circuitry in a second configuration determines the desired power level based on a pattern density in the first set of message frames corresponding to the lighting zone, and adjusts the output current of the ballast accordingly.

11. The system of claim 10, in which the control circuitry in the first configuration upon failing to detect the second set of message frames determines the desired power level based on the pattern density in the first set of message frames corresponding to the lighting zone, and adjusts the output current of the ballast accordingly.

12. The system of claim 10, wherein the second set of message frames comprises a first frame having a hamming-encoded bit pattern corresponding to a first digit of the desired power level, and a second frame having a hamming-encoded bit pattern corresponding to a second digit of the desired power level.

13. The system of claim 12, wherein the first and second frames being transmitted consecutively across the AC power line, and wherein the control circuitry detects the second set of message frames upon consecutively detecting each of the first and second message frames.

14. The system of claim 13, wherein a plurality of second sets of message frames being transmitted by the encoding circuit consecutively across the AC power line, wherein the control circuitry detects the second set of message frames upon consecutively detecting each of the first and second message frames in any one or more of the second sets of message frames.

15. The system of claim 10, wherein each frame in the first set of message frames comprises an even number of bits, and each frame in the second set of message frames comprises an odd number of bits, and the control circuitry detects the second set of message frames based on the respective number of bits.

16. The system of claim 10, wherein the control circuitry determines the desired power level based on a density of the bit pattern corresponding to the lighting zone by:

comparing the received pattern with a plurality of stored patterns defining unique symbols, each symbol selected in accordance with a minimum Hamming distance between the symbol and each other symbol;

determining the symbol associated with the received pattern;

determining a logic condition for the lighting zone based on the determined symbol; and applying control signals to the ballast in accordance with the determined logic condition.

17. The system of claim 16, wherein a density of the determined logic condition over a predetermined number of message frames corresponds to the desired power level on a percentage scale.

18. The system of claim 17, wherein a minimum Hamming distance of three is defined between each defined symbol.

19. The system of claim 18, wherein the control circuitry determines the symbol associated with the received pattern by determining a Hamming distance between the received pattern and each defined symbol and identifying the defined symbol having the smallest Hamming distance with respect to the received pattern.

20. A power line communication system for an lighting dimming control comprising:

at least one encoding circuit which encodes an AC mains signal with bit patterns further transmitted across an AC power line, the encoded bit patterns comprising a first set of patterns corresponding to zone symbols having a pattern density associated with a desired dimming level, and a second set of patterns comprising one or more hamming-encoded bit patterns corresponding to respective hexadecimal digits of the desired dimming level;

an electronic dimming ballast coupled to the AC power line and comprising control circuitry, the control circuitry in a first configuration detects the second set of patterns, decodes the hamming-encoded digits and immediately adjusts an output current of the ballast to a value proportional to the desired dimming level, and the control circuitry in a second configuration determines the desired dimming level based on the pattern density of the zone symbols.

* * * * *